US005970579A

United States Patent [19]

Lu

[11] Patent Number: 5,970,579

[45] Date of Patent: Oct. 26, 1999

[54] HANDLE ASSEMBLY FOR A WHEELED LUGGAGE CASE

[75] Inventor: Lien-Ching Lu, Miao Li Hsien, Taiwan

[73] Assignee: Ting Cheng Co., Ltd., Miao Li Hsien, Taiwan

[21] Appl. No.: 09/081,081

[22] Filed: May 19, 1998

[51] Int. Cl.[6] ..... A47B 95/02

[52] U.S. Cl. ..... 16/115; 280/655

[58] Field of Search ..... 16/115, 111 R, 16/DIG. 41; 190/18 A, 18 R, 14, 15 R, 104, 115; 280/47.315, 47.371, 655, 655.1

[56] References Cited

U.S. PATENT DOCUMENTS 5,371,923 12/1994 Chang ..... 16/115

5,553,350 9/1996 Chang ..... 16/115

*Primary Examiner*—Chuck Y. Mah

*Attorney, Agent, or Firm*—Rosenberg, Klein & Bilker

[57] ABSTRACT

A handle assembly for a wheeled luggage case includes two outer tubes, two inner tubes respectively and retractably received in the two outer tubes, a rotated handle connected between the two inner tubes, two actuating means respectively in the inner tubes, and two rods received in the inner tubes and operatably engaged with the actuating means. The rotated handle has two ends to push the two rods to actuate the actuating means when the rotated handle is rotated. The actuating means each have a positioning member received therein so as to position the inner tubes corresponding to the outer tubes.

6 Claims, 4 Drawing Sheets

HANDLE ASSEMBLY FOR A WHEELED LUGGAGE CASE

BACKGROUND OF THE INVENTION

1. Field of the Invention

The present invention relates to a handle assembly and, more particularly, to an improved collapsible handle assembly for a wheeled luggage case. The assembly includes a rotatable handle to actuate positioning members disposed in two inner tubes of the assembly so that the inner tubes can be pulled or retracted corresponding to the outer tubes.

2. Brief Description of the Prior Art

There are many kinds of wheeled luggage cases in the market for carrying of baggage during traveling. Most of such wheeled luggage cases are collapsible to save space requirement for their storage. However, the security and contractibility of their contractible rods are always problems of the conventional wheeled luggage cases, because the contractible rods have to be retracted with enough strength, but they will be damaged when the strength is too much; which means they are not easy to be controlled to a proper position. Hence, use of the conventional contractible luggage cases is not convenient, and their use is not sufficiently safe. In view of the above defects, the inventor has created a new structure of a handle assembly for a wheeled luggage case.

The present invention intends to provide an improved handle assembly to mitigate the above mentioned problems. The handle assembly of the present invention comprises a rotated handle has two base members respectively covering the two ends thereof, two inner tubes each are retractably disposed in a respective outer tube and connected to a respective base member of the rotated handle at one end thereof, and two actuating means are respectively disposed in the other end of the inner tubes; so that the inner tubes can be moved corresponding to the outer tubes by rotating the handle.

SUMMARY OF THE INVENTION

In one aspect of the present invention, there is provided a handle assembly for a wheeled luggage case and comprising two outer tubes each having a plurality of first apertures defined through an inner peripheral wall thereof, two inner tubes each disposed in the outer tubes corresponding thereto and having a second aperture defined through an inner peripheral wall thereof, two actuating means are respectively disposed in the bottom end of the inner tubes, two rods are respectively disposed in the inner tubes and contacted with the actuating means, and a rotated handle with two base members respectively covering the two ends thereof.

Each of the actuating means includes a bottom with a first plate and a second plate respectively extending from two opposite sides thereof. The first plate has a first hole defined therethrough and an inclined surface defined in a distal end thereof. The second plate includes a curved plate having a distal end located above the inclined surface. Each of the actuating means has a positioning member disposed therein which is biased to be engaged with a periphery defining the first hole corresponding thereto.

Two rods are respectively received in the respective inner tubes and each of the rods has a slot defined in a top end thereof which is movably received in the top end of the inner tube corresponding thereto by extending a pin through the inner tube and the slot. The rods each have a bottom end thereof contacting against the curved plate corresponding thereto such that when the rods are moved downwardly to push the respective curved plates, the distal ends of the curved plates push the respective inclined surfaces of the first plates which are pushed together with the positioning members toward the respective second plates.

Each of the two base members covering the end of the rotated handle has a neck received to the top end of the inner tube, a transverse tube portion which has a receiving recess defined longitudinally therein which communicates with a passage defined through the neck, and a cap mounted an outer end of transverse tube portion with a pin. The two ends of the rotated handle each have a protrusion extending radially and outwardly therefrom such that when rotating the handle, the two rods are pushed toward the respective actuating means by the protrusions.

It is an object of the present invention to provide a handle assembly for a wheeled case, wherein the handle assembly is operated by rotating the rotated handle.

It is another object of the present invention to provide a handle assembly for a wheeled luggage case, wherein the rotated handle is rotated to push two rods in the inner tubes to retract two positioning members in the inner tubes so that the inner tubes can be pulled or retracted corresponding to the outer tubes.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
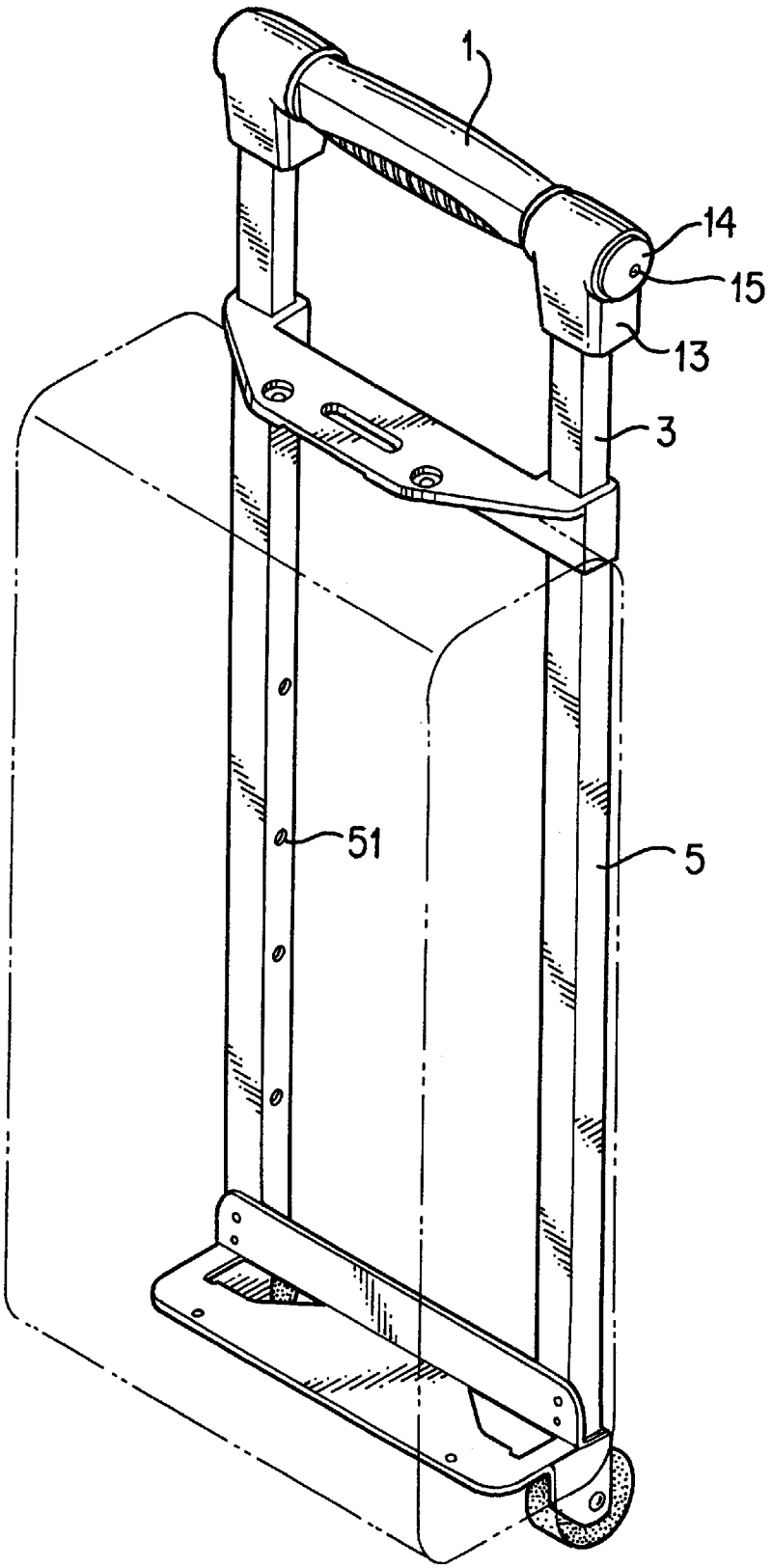
FIG. 1 is a perspective view of a handle assembly in accordance with the present invention, wherein a box attached to the handle assembly is shown in phantom lines.

Referring to the drawings and initially to FIGS. 1, 2, 3 and 4, a handle assembly in accordance with the present invention generally includes two outer tubes 5 each having a plurality of first apertures 51 defined through an inner peripheral wall thereof. Two inner tubes 3 each are disposed in the outer tubes 5 corresponding thereto and have a second aperture 32 defined through an inner peripheral wall thereof. The two inner tubes 3 each have an actuating means 4 fixedly received in a bottom end thereof by a bolt 46.

Each of the actuating means 4 includes a bottom with a first plate 40 and a second plate 401 respectively extending from two opposite sides thereof. The first plate 40 has a first hole 43 defined therethrough and a first inclined surface 412 defined in a distal end thereof. The second plate 401 includes a curved plate 42 which has a distal end having a second inclined surface 411 located above the first inclined surface 412 of the first plate 40. Each of the actuating means 4 has positioning member 44 disposed therein by a spring member 48, the positioning member 44 being biased to be engaged with a periphery defining the first hole 43 corresponding thereto. Accordingly, when the positioning members 44 extend through the respective second apertures 32 and two of the first apertures 51, the inner tubes 3 are positioned corresponding to the outer tubes 5.

Two rods 2 are respectively received in the respective inner tubes 3, each of the rods 2 having a slot 21 defined in a first end thereof which is movably received in the top end of the inner tube 3 corresponding thereto by extending a pin 311 through the inner tube 3 and the slot 21. The rods 2 each have a second end thereof contacting against the curved plate 42 corresponding thereto and in order to well position the second end of each of the rods 2 on the curved plates 42, each of the curved plates 42 has two ribs 421 extending from a top thereof such that the second end of each of the rods 2 is located between the two ribs 421 corresponding thereto.

Figures 2, 2A:
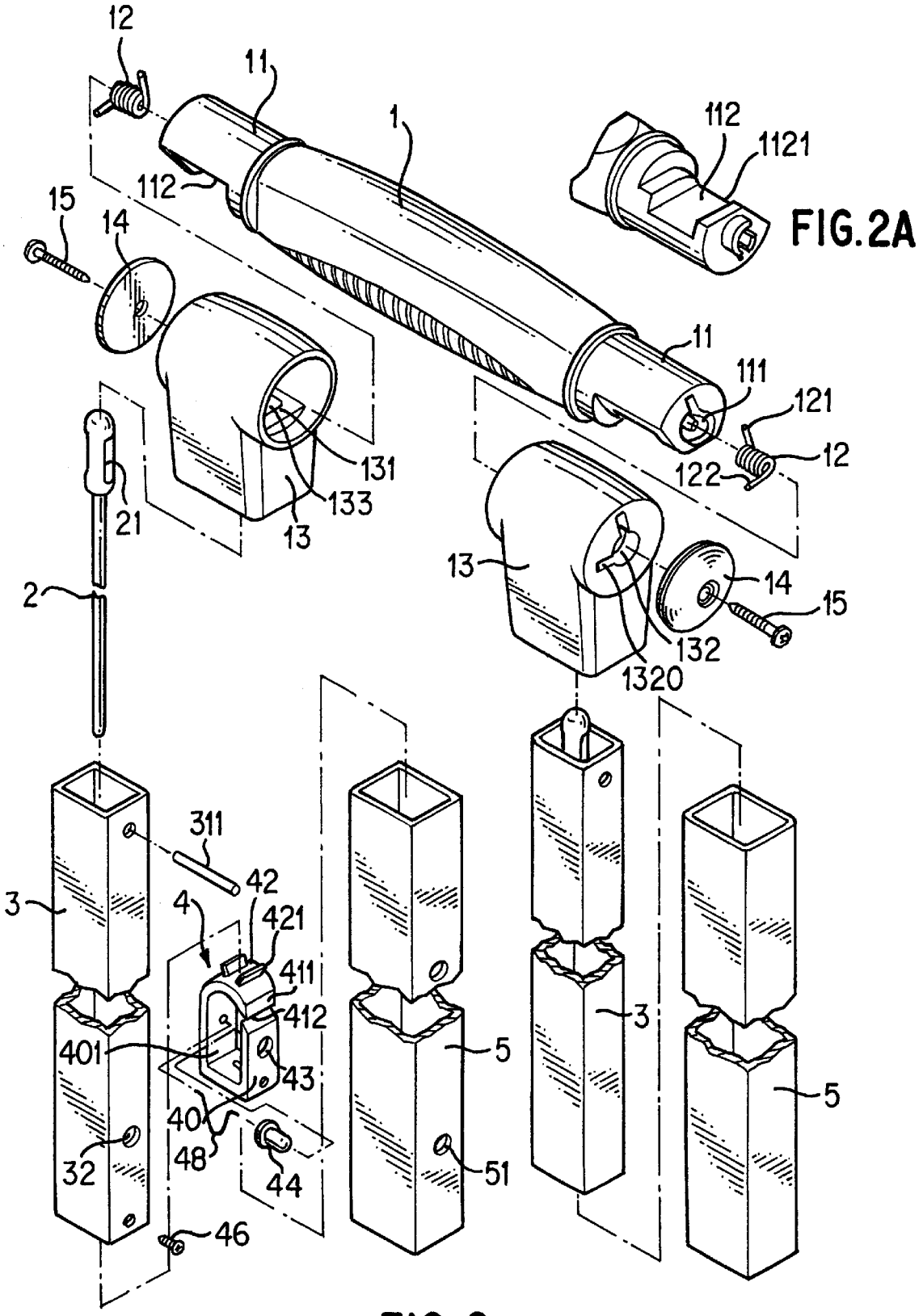
FIG. 2 is an exploded view of the handle assembly in accordance with the present invention.
FIG. 2A is a perspective view of either one of two ends of the rotated handle and viewed from an underside thereof.
Figure 4:
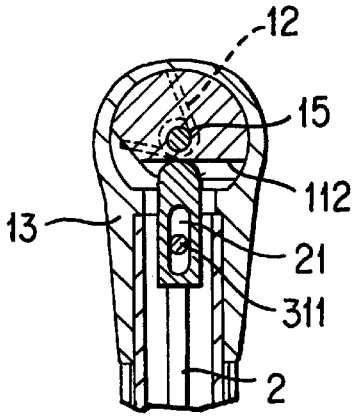
FIG. 4 is a side elevational view, partly in section, of the rotated handle contacting the rod when the rotated handle is not rotated.
Figure 3:
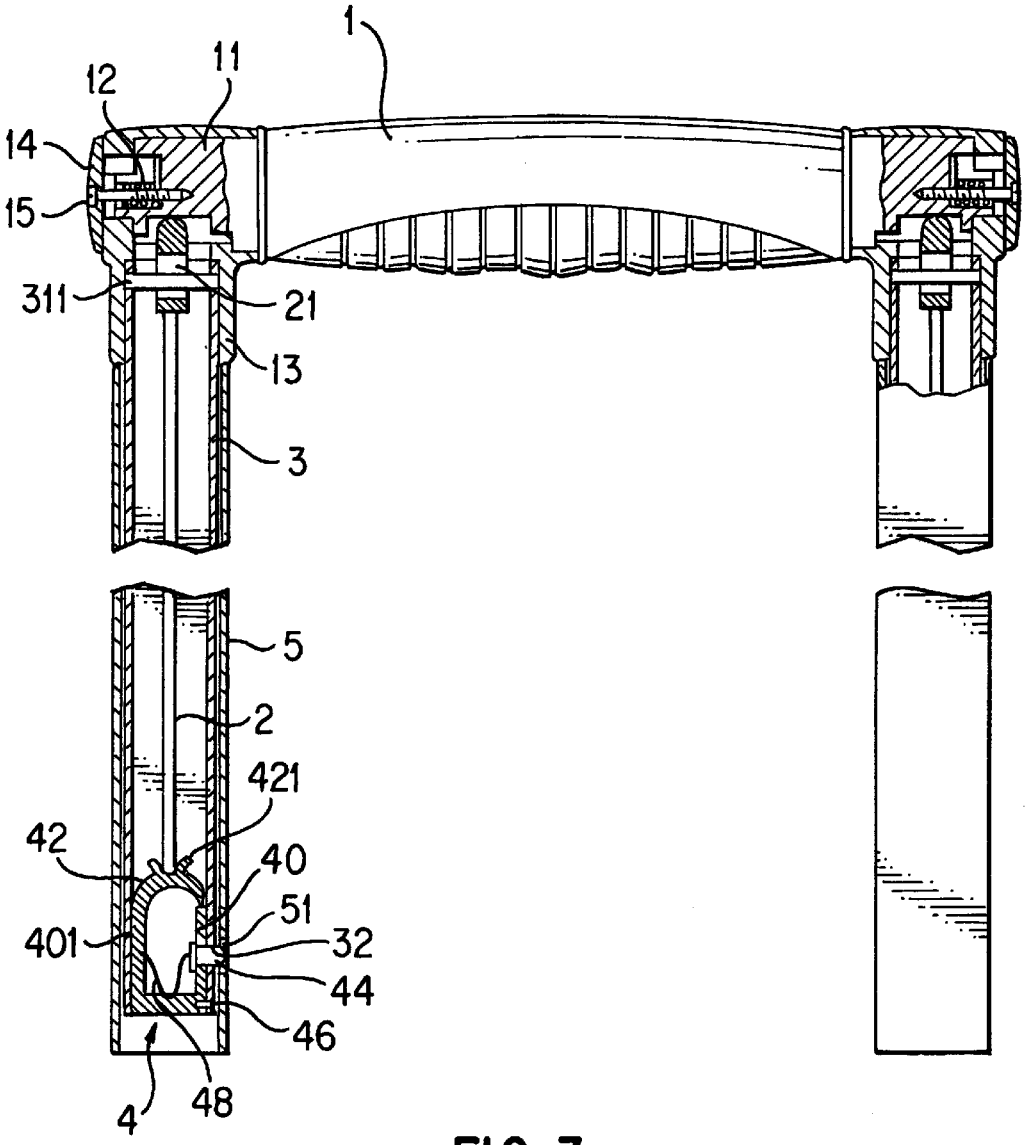
FIG. 3 is a side elevational view, partly in section, of the rotated handle assembly when the rotated handle is not rotated.

Further referring to FIGS. 2 and 2A, a rotated handle 1 has two base members 13 covering two ends 11 thereof, each two base members 13 has a neck mounted to the top end of the inner tube 3 and a transverse tube portion which has a receiving recess 131 defined longitudinally therein which communicates with a passage 133 defined through the neck. The two ends 11 are received in the receiving recesses 131 of the two transverse tube portions of the two base members 13. Each of the ends 11 has a first plain surface 112 and a second plain surface 1121 defined radially therein, the first plain surface 112 located beside the second plain surface 1121. A distance normal to the first plain surface 112 and from the first plain surface 112 to a center of the end 11 is shorter than a second plain surface 1121 to the center of the end 11. Therefore, the second plain surface 1121 is a protrusion corresponding to the first plain surface 112. Each of the first plain surfaces 112 contacts the first end of the rod 2 corresponding thereto when the rotated handle 1 is not rotated.

Each of the ends 11 has a first recess 111 defined in a distal end thereof and each of the transverse tube portions of the base members 13 has a second recess 132 defined in an outer end thereof so that two torsion springs 12 are respectively received in the two pairs of the first recess 111 and the second recess 132. Each of the first recesses 111 has a first slit 1110 extending inclinedly and radially outward therefrom so as to received a first leg 121 of the torsion spring 12 corresponding thereto, and each of the second recesses 132 has a second slit 1320 extending inclinedly and radially outward therefrom so as to received a second leg 122 of the torsion spring 12 corresponding thereto. Two caps 14 are respectively mounted to the two outer ends of the respective transverse tube portions of the base members 13 and two pins 15 respectively extend through the two caps 14, the two torsion springs 12 and fixedly connected the ends 11 so that the rotated handle 1 can be rotated about the two pins 15.

Figure 6:
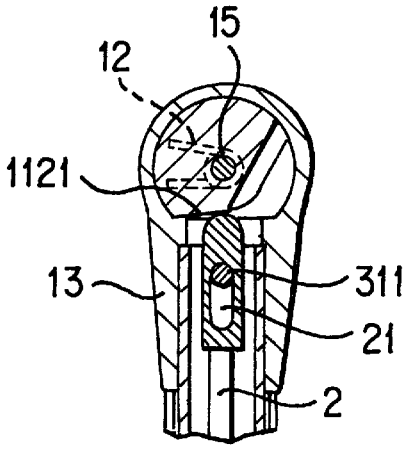
FIG. 6 is a side elevational view, partly in section, of the rotated handle is rotated and pushed the rod.
Figure 5:
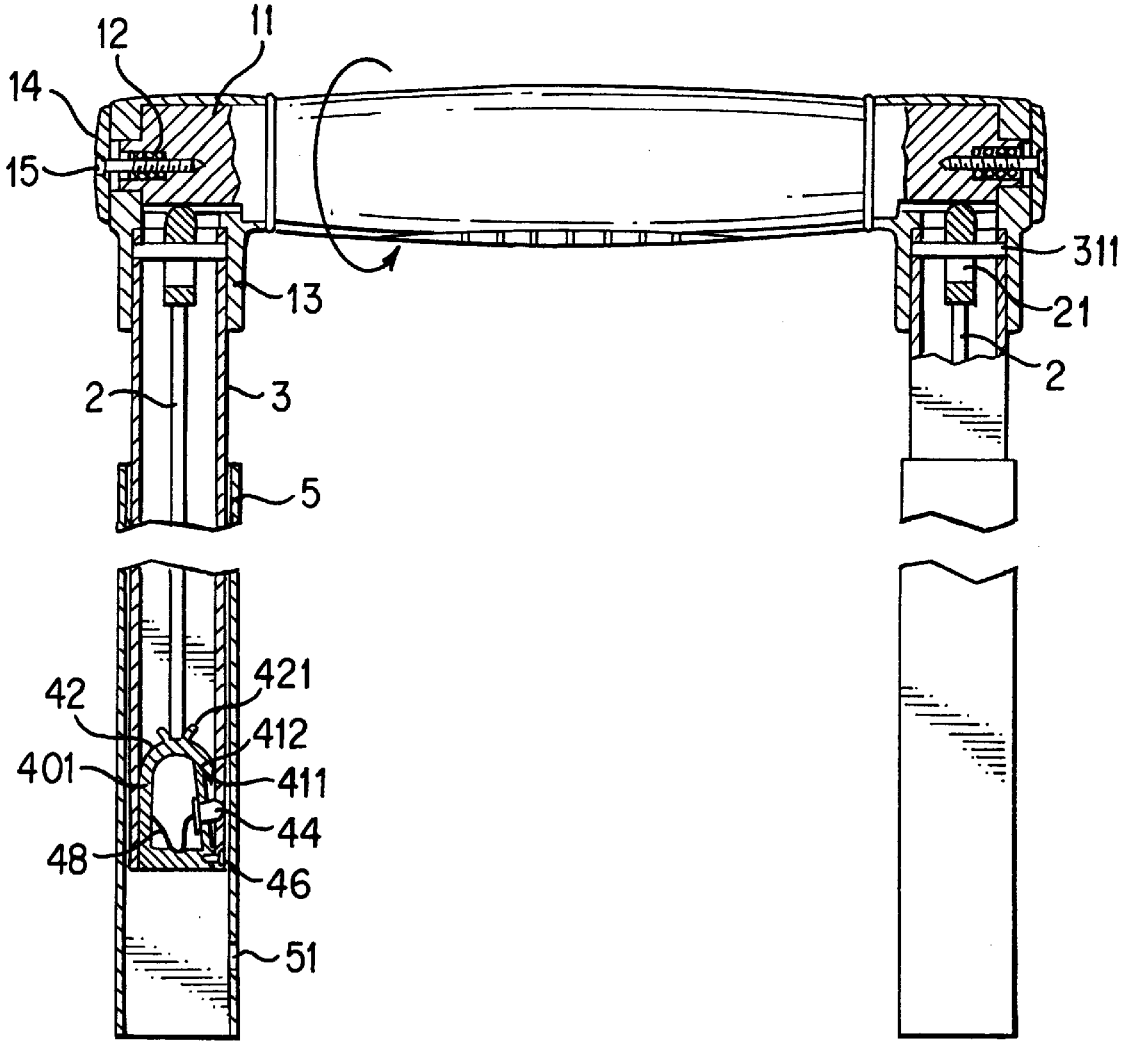
FIG. 5 is a side elevational view, partly in section, of the rotated handle assembly when the rotated handle is rotated.

Referring to FIGS. 5 and 6, when a user wants to adjust the inner tubes 3 of the handle assembly, he/she rotates the rotated handle 1 and the rods 2 are moved downwardly by the second plain surfaces 1121 (the protrusions) to push the second ends of the rods 2 to the respective curved plates 42. The second inclined surfaces 411 of the distal ends of the curved plates 42 then push the respective first inclined surfaces 412 of the first plates 40, the first plates 40 then are pushed together with the positioning members 44 toward the respective second plates 401 so that the positioning members 44 are moved from the first apertures 51 corresponding thereto and the inner tubes 3 are able to be moved till a desired position wherein the positioning members 44 are received in another first apertures 51 again. The rotated handle 1 will rotated reversely by the torsion springs 12 when the user releases the rotated handle 1.

Accordingly, the handle assembly of the present invention is easily to be operated simply by rotation the rotated handle 1.

Although the invention has been explained in relation to its preferred embodiment, it is to be understood that many other possible modifications and variations can be made without departing from the spirit and scope of the invention as hereinafter claimed.

I claim:

1. A handle assembly for a wheeled luggage case, comprising:

(a) a rotatable handle including:

(i) first and second end portions, (ii) a first recess extending longitudinally within each of said first and second end portions, said first recess having an opening defined in a distal end of each said first and second end portions of said rotatable handle, (iii) a first slit extending radially from said opening at said distal end of each said end portion of said rotatable handle, and (iv) a first plain surface and a second plain surface being defined at each said first and second end portions of said rotatable handle, each said second plain surface extending angularly from a respective first plain surface;

(b) a pair of outer tubes, each of said outer tubes having an inner peripheral wall with a plurality of first apertures formed through said inner peripheral wall;

(c) a pair of inner tubes, each said inner tube being slidingly received within a respective one of said outer tubes, each said inner tube having an inner peripheral wall and a second aperture formed through said inner peripheral wall of each said inner tube;

(d) actuating means received within each said inner tube at a bottom end thereof for reversibly displacing a respective positioning member through said second aperture and a selected one of said first apertures;

(e) a pair of base members, each base member being mountable on a respective one of said first and second end portions of said rotatable handle, each said base member including a neck mountable to a top end of a respective one of said inner tubes, and a transverse tube portion extending transversely with respect to said neck, said neck having a passage formed therein, said top end of each said inner tube being received within said passage in said neck of a respective base member, said transverse tube portion having an inner end and an outer end and a receiving recess formed therein and extending longitudinally, said receiving recess being in open communication with said passage within said neck of said base member and receiving a respective one of said first and second ends of said rotatable handle therein, said outer end having a second recess formed therein, and said outer end having a second slit formed therein, said second slit extending radially from said second recess;

(f) a pair of torsion springs, each torsion spring having a first leg and a second leg spaced each from the other, each of said torsion springs being received within a respective first recess, said first leg of said torsion spring being received within said first slit and said second leg of said torsion spring being received within said second slit;

(g) a pair of rods, each of said rod being received in a respective one of said inner tubes, each of said rods having a slot formed in an upper end thereof, said upper end of said rod being movably received in said top end of said inner tube; and (h) a pair of pins, each said pin passing laterally through a respective one of said inner tubes and said slot defined in said upper end of said rod, wherein during rotation of said rotatable handle, said second plain surfaces of each said end portions of said rotatable handle respectively engage said upper ends of said rods and push said rods downward towards said actuating means.

2. The handle assembly as claimed in claim 1, wherein each of said base members further includes a cap mounted to said outer end of said transverse tube portion, each said pin extends through said cap and said torsion spring, and into a respective end of said rotatable handle for rotation about said pins.

3. The handle assembly as claimed in claim 1, wherein each of said actuating means includes a first plate and a second plate respectively extending from two opposite sides of a bottom end of said actuating means, said first plate having a first hole formed therethrough and an inclined surface defined in a distal end thereof, said second plate including a curved plate having a distal end located above said inclined surface of said first plate, each said positioning member being coupled to said first plate and being biased to be engaged with a periphery of said first hole.

4. The handle assembly as claimed in claim 3, wherein each of said rods has a lower end thereof contacting said curved plate of said actuating means, such that when each said rod is moved downwardly to push said respective curved plate, said distal end of said curved plate pushes said respective inclined surface of said first plate, thereby displacing said first plate and said positioning member towards said second plate.

5. The handle assembly as recited in claim 3, wherein said curved plate further includes two ribs extending from a top thereof, such that said lower end of said rod is located between said two ribs.

6. The handle assembly as claimed in claim 1, wherein said first plain surface of each said end portion of said rotatable handle contacts said upper end of a respective one of said rods when said rotatable handle is not rotated.

* * * * *